US005775354A

United States Patent [19]

Upton

[11] Patent Number: 5,775,354

[45] Date of Patent: Jul. 7, 1998

[54] FLEXIBLE HOSE TAKE-UP ASSEMBLY

[75] Inventor: W. Lovelle Upton, Collins, Miss.

[73] Assignee: Upton Limited Partnership, Collins, Miss.

[21] Appl. No.: 795,085

[22] Filed: Feb. 5, 1997

[51] Int. Cl.[6] ..... E03B 1/00

[52] U.S. Cl. ..... 137/1; 137/355.25; 137/355.23

[58] Field of Search ..... 137/1, 355.25, 137/355.23, 355.2

[56] References Cited

U.S. PATENT DOCUMENTS

| | | | |
|---|---|---|---|
| 2,026,327 | 12/1935 | Sparling | 137/355.25 |
| 2,118,294 | 5/1938 | Cox . | |
| 2,157,887 | 5/1939 | Davis . | |
| 2,168,951 | 8/1939 | Caldwell . | |
| 2,174,099 | 9/1939 | Vogler et al. . | |
| 2,225,859 | 12/1940 | Cox . | |
| 2,694,601 | 11/1954 | Higginbotham | 137/355.25 |
| 2,744,788 | 5/1956 | Grise | 137/355.23 |
| 4,009,800 | 3/1977 | Loy et al. . | |
| 4,023,387 | 5/1977 | Gould | 137/355.23 |
| 5,117,859 | 6/1992 | Carlson . | |
| 5,450,874 | 9/1995 | Hamula | 137/355.23 |

*Primary Examiner*—Denise L. Ferensic
*Assistant Examiner*—John Ball
*Attorney, Agent, or Firm*—Isaf, Vaughan & Kerr

[57] ABSTRACT

A flexible hose take-up assembly for automatically retracting a flexible fluid dispensing hose is disclosed. A cabinet having an interior chamber at least partially filled with a damping liquid houses a pulley assembly and a pair of counterweights used to control flexible hose pay out and retraction. A flexible hose of the type used in automotive service centers is attached to the ends of the cable of the pulley assembly such that the hose is stored adjacent the exterior of the cabinet when in the stored position. The pulley assembly permits the movement of the counterweights carried by the pulley assembly, the counterweights being at least partially immersed in the damping liquid, in a first direction away from a home position within the cabinet in response to the movement of the flexible hose from its stored position to one of its fluid dispensing positions, and permits the gravitational movement of the counterweights through the liquid in a second direction back toward the home position in response to the release of the hose from its fluid dispensing position. The hydraulic damping imposed on the counterweights by the liquid provides a uniformly controlled rate of retraction and substantially eliminates hose snap-back during movement in the second direction.

19 Claims, 4 Drawing Sheets

FLEXIBLE HOSE TAKE-UP ASSEMBLY

FIELD OF THE INVENTION

The present invention relates in general to take-up assemblies for hoses used in automotive service centers, service stations and other similar environments. More particularly, this invention relates to a gravity-operated hose return mechanism that controls the retraction rate of the hose while it is returned to the stored position.

BACKGROUND OF THE INVENTION

Heretofore, various retractable air and water hose mechanisms have been employed in automotive service centers, garages, and the like for the general purpose of automatically returning the air, water, and other types of hoses to a stored configuration after use. Typically, these mechanisms are housed within some type of cabinet, either above or below ground, in order to protect the mechanism from damage due to the weather, handling, or contact with moving objects in the service centers. Typically, the hose or hoses are also stored within the cabinet when not in use. A common example of such a device is a spring loaded hose reel housed within a cabinet.

When a service center technician or customer desires to add water to the radiator of a vehicle, or air to the tire of a vehicle, for example, the technician or customer simply moves the vehicle within a general vicinity of the cabinet, and pulls the desired hose (water or air) protruding from the cabinet to the desired point of use. Once filling is complete, the technician or customer simply releases the hose and the retraction mechanism within the cabinet quickly withdraws the hose back into the stored position within the cabinet. Sometimes, however, the cable is retracted too quickly so that it snaps back into the cabinet with the result that the valve on the end of the hose becomes damaged, or the hose/valve may injure persons in the vicinity of the hose, as well as possibly damaging the automobile being serviced.

Early hose retraction mechanisms were extremely complex and combined a number of devices to perform the retraction function. Pulleys, springs, counterweights, chains and cables, together, have all been components of a single mechanism designed to perform the retraction function. The complex arrangement of, and inter-relationships between all of these elements within a single cabinet often results in a retraction mechanism that is expensive to manufacture, difficult to service and maintain, and susceptible to breakage and other malfunctions. In addition, the focus of the early designers of such mechanisms was quick retraction. As a result, damage to the peripheral attachments such as hoses, clamps, nozzles, handles and the like associated with these retraction mechanisms is frequent. This normal wear and tear is generally the result of the violent contact of these attachments with the retraction mechanism cabinet following what is known as hose "snap-back," described generally above.

Early examples of such hose retraction mechanisms are disclosed in the patent to Davis, U.S. Pat. No. 2,157,887, issued May 9, 1939, and in the patent to Cox, U.S. Pat. No. 2,225,859, issued Dec. 24, 1940. Both of these patents disclose hose retraction mechanisms that use a gravity return to retract the respective hoses from a position of use to a position of storage. Both devices employ fixed counterweights which results in the greatest return force being delivered to the hoses when the hose is near the fully retracted position. This occurs because the counterweight of the hose and its contents already retracted is added to the fixed counterweights as the hose is being withdrawn. The greater the fixed counterweight, the greater the velocity of retraction, and thus, the condition known as hose "snap-back." Repeated hose "snap-back" over time results in damage to the hose, the fittings, the nozzles, and the cabinet itself. If devices such as these are positioned too close to fuel pumps or fuel tanks at the service centers, a safety hazard can also result. Sparks caused by the nozzle to cabinet contact resulting from "snap-back" can easily ignite standing fuel, fuel-soaked rags, other fuel-soaked debris or fuel fumes.

An early attempt to solve the problem of hose "snap-back" is disclosed in the patent to Caldwell, U.S. Pat. No. 2,168,951, issued Aug. 8, 1939. Caldwell discloses a hose return mechanism that uses an elongated link chain as a substitute for the counter-balancing counterweights. When in the stored position, the elongated chain rests in the bottom of an underground well. As the hose is withdrawn for use, links from the chain are progressively raised out of the well. When the hose is released, the counterweight of the chain provides a return pull on the hose which decreases as the links of the chain settle to the bottom of the well as the hose is retracted. The settling of the chain results in the diminishing of the counterweight when the hose is being drawn into the housing. If, however, the hose is snagged or otherwise contacts an object along its return path, the hose retraction will likely be stopped due to the insufficient amount of counterweight placed on the hose by the remaining chain. The result being a partially retracted hose.

A more recent approach to this problem is disclosed in U.S. Pat. No. 5,117,859 to Carlson, issued Jun. 2, 1992. Carlson discloses an above-ground gravity return hose retractor stored within a cabinet. The hose retractor uses a vertically moveable pulley sheave having a non-linear, variable counterweight attached to the pulley sheave to control the rate of hose retraction. Upon release of the hose, the variable counterweight exerts the greatest pulling force upon initial retraction of the hose, and the retraction pulling force decreases non-linearly to its lowest value when the hose is nearly fully retracted. While the wear and tear on the hose and other attachments is reduced as a result of this device, the "snap-back" problem is still not eliminated. Upon release, the hose is still initially travelling at a high rate of velocity. Thus, the hose and its attachments are susceptible to being damaged en route to the cabinet. Additionally, the rapidly travelling hose creates an injury hazard to service center workers and patrons alike.

While several of the hose retraction mechanisms described above return water, air and other hoses to a stored position within a cabinet, it appears that none disclose a hose retraction mechanism that controls the rate of hose withdrawal throughout the entire return path of the hose. Additionally, none of the above-mentioned devices effectively eliminates hose "snap-back."

What is needed, therefore, but seemingly unavailable in the art, is a hose take-up assembly which is simple in structure, effective in operation, and which eliminates "snap-back." Moreover, what is needed but unavailable in the art is a hose take-up assembly which is easy to maintain and safe to use in an automobile service center environment.

SUMMARY OF THE INVENTION

The present invention provides an improved flexible hose take-up assembly for use in automotive service centers, service stations, and other environments in which flexible hoses are used to deliver fluids (i.e., gases and liquids) to locations at various distances from the fluid source, which overcomes some of the design deficiencies of other hose take-up assemblies known in the art. The hose take-up assembly of this invention provides a simple, efficient, and inexpensive apparatus for automatically retracting hoses of various lengths and diameters once the hose is no longer in use. The relative simplicity of the present invention in comparison with known hose take-up assemblies will lead to a reduction in the number of malfunctions associated with continued use of the apparatus. Thus, maintenance costs and other overhead expenses associated with maintaining the hose take-up assembly of the present invention are relatively low when contrasted to the known devices.

This invention attains this high degree of efficiency due to its unique and novel design. Typical hose take-up assemblies are designed so that the moving parts are protected from exposure to liquids, such as water, that contribute to the oxidation and corrosion of metals. In contrast, the present invention is designed so that the vast majority of moving parts are not only exposed to, but are actually immersed within, a liquid.

The assembly includes an above-ground cabinet defining a liquid filled chamber, a "block and tackle" type pulley assembly including a cable housed within the cabinet, and a pair of counterweights attached to the pulley assembly and carried thereon for movement within the cabinet. Unlike most above-ground take-up assemblies known in the art, the present invention is adapted for external storage of the hose to be retracted. The cable of the block and tackle pulley assembly is passed over each of the pulleys housed within the cabinet to transfer the pulling force applied by a user to the fluid dispensing hose and the counterweights, and is fitted at each end with a clamp. Each end of the cable extends outwardly from the assembly through a separate opening located near the open end of the cabinet. The clamps are sized and shaped such that they prevent the ends of the cable from being retracted back into the cabinet through the openings, and are used to attach the ends of the cable to a flexible fluid dispensing hose. Generally speaking, the flexible hoses are of the type used to deliver air, water, oil and other liquids. However, hoses used to deliver other gases, slurries, and mixtures can also be used with the present invention.

The clamps are spaced apart from each other along the length of the fluid dispensing hose and fixedly attached thereto. Thus, when the hose is in its stored configuration adjacent the exterior of the cabinet, the hose is looped such that there is a series of alternating peaks and valleys in the vertical direction in what is known as an accordion arrangement. The ends of the hose hang freely and can easily be attached to respective tanks and nozzles for permitting the controlled delivery of the desired fluid.

The unique and novel structure of this invention thus provides a simple, yet inexpensive apparatus and method for eliminating hose snap-back after the hose has been pulled out of the stored position, used to deliver fluid, and subsequently released by the user. When the user desires to deliver fluid from the hose, the user simply grasps the nozzle end of the hose and pulls it in the direction of the fluid delivery location. As a result of the mechanical advantage provided by the pulley assembly, the first and second counterweights are independently elevated within the cabinet as the hose is pulled out of the stored position. As the hose is pulled, the first end of the cable clamped to the hose is withdrawn from one of the openings in the cabinet and the first counterweight begins to rise along the cable within the cabinet. As the first counterweight approaches the top of the cabinet, the lifting force provided by the user is transferred to the second counterweight by the pulley assembly. Thus, the second counterweight begins to rise and the second end of the cable clamped to the hose is withdrawn from the other of the openings in the cabinet. The hose reaches its maximum pay out length when both the first and the second counterweights contact a stop located near the top of the cabinet.

When the user completes fluid delivery via the hose, the user can simply release the hose and the hose is automatically retracted into the stored position adjacent the cabinet without snapping back. When the hose is released, the tension is no longer applied to the cable by the user, thus the mechanical advantage supplied by the pulley assembly will no longer overcome the force of gravity. As a result, and through the force of gravity, the counterweights begin to descend within the cabinet and the cable is simultaneously retracted into the openings located near the open end of the cabinet. Unlike other hose take-up assemblies, however, the descent of the counterweights in the present invention is hydraulically controlled. When the damping liquid is at an optimal level within the cabinet the counterweights are hydraulically controlled throughout the entire distance of their descent. Thus, hose snap-back is greatly eliminated and the return rate of the hose to the stored position is uniformly controlled.

The unique and novel structure of this invention thus provides an effective device for eliminating hose snap-back without the need to include expensive electrical or pneumatic retraction devices. Moreover, the novel apparatus of this invention allows for a high degree of flexibility in hose selection and cabinet location. Further, the present invention allows for greater ease of maintenance, greater ease of use, and reduced overall overhead associated with operating and maintaining such a hose take-up assembly. Accordingly, the objects of the present invention include the ability to eliminate hose snap-back, the ability to easily and inexpensively retrofit existing service centers and the ability to use the hose take-up assembly of the present invention with hoses of various diameters and constructed of various materials. The objects and advantages of the present invention will be more readily apparent from the following detailed description, read in conjunction with the accompanying drawings.

DETAILED DESCRIPTION OF THE PREFERRED EMBODIMENTS

Figure 1:
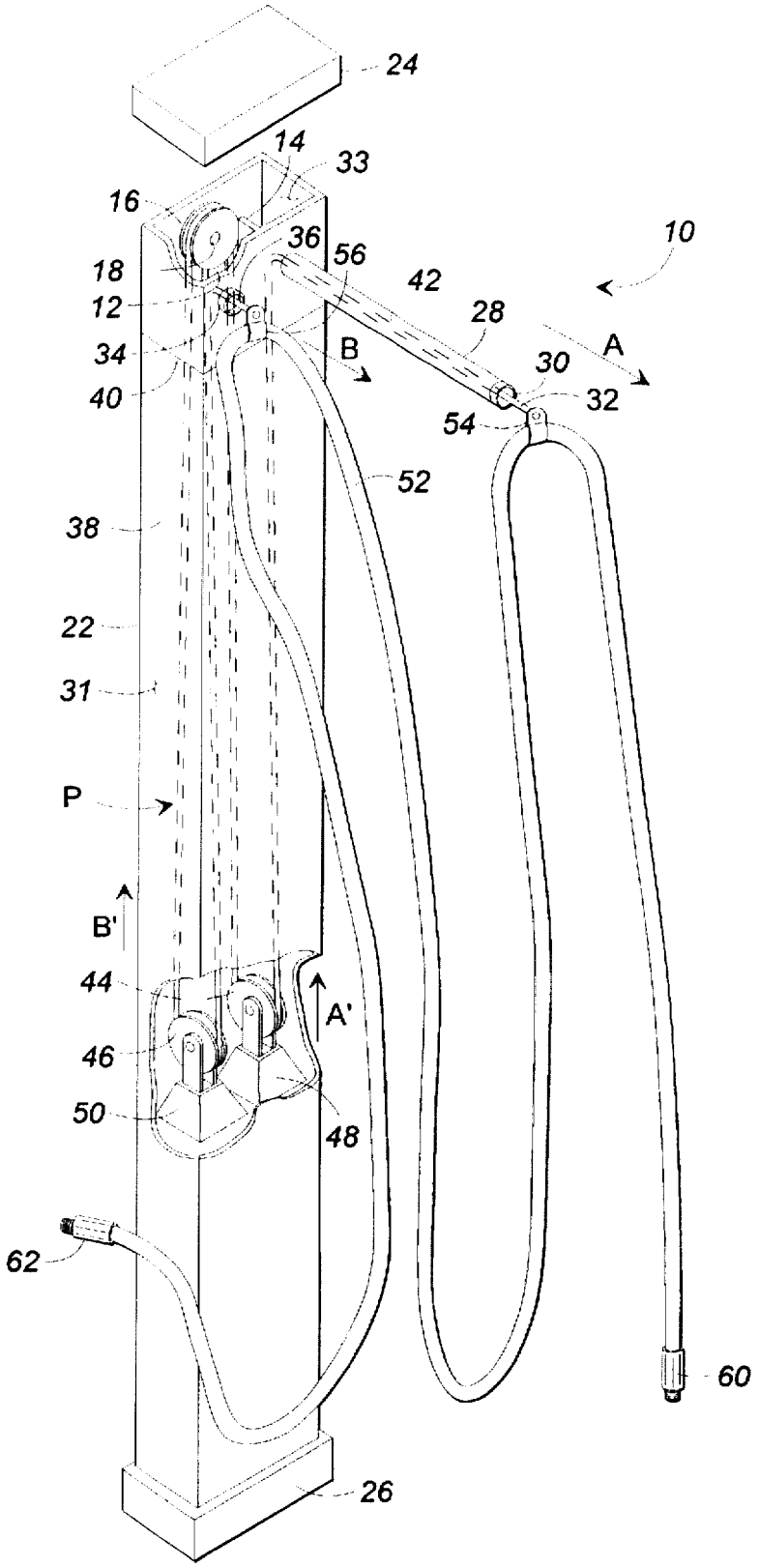
FIG. 1 is a partially cut-away perspective view of a first embodiment of the hose take-up assembly shown supporting a hose in the stored position.
Figure 2:
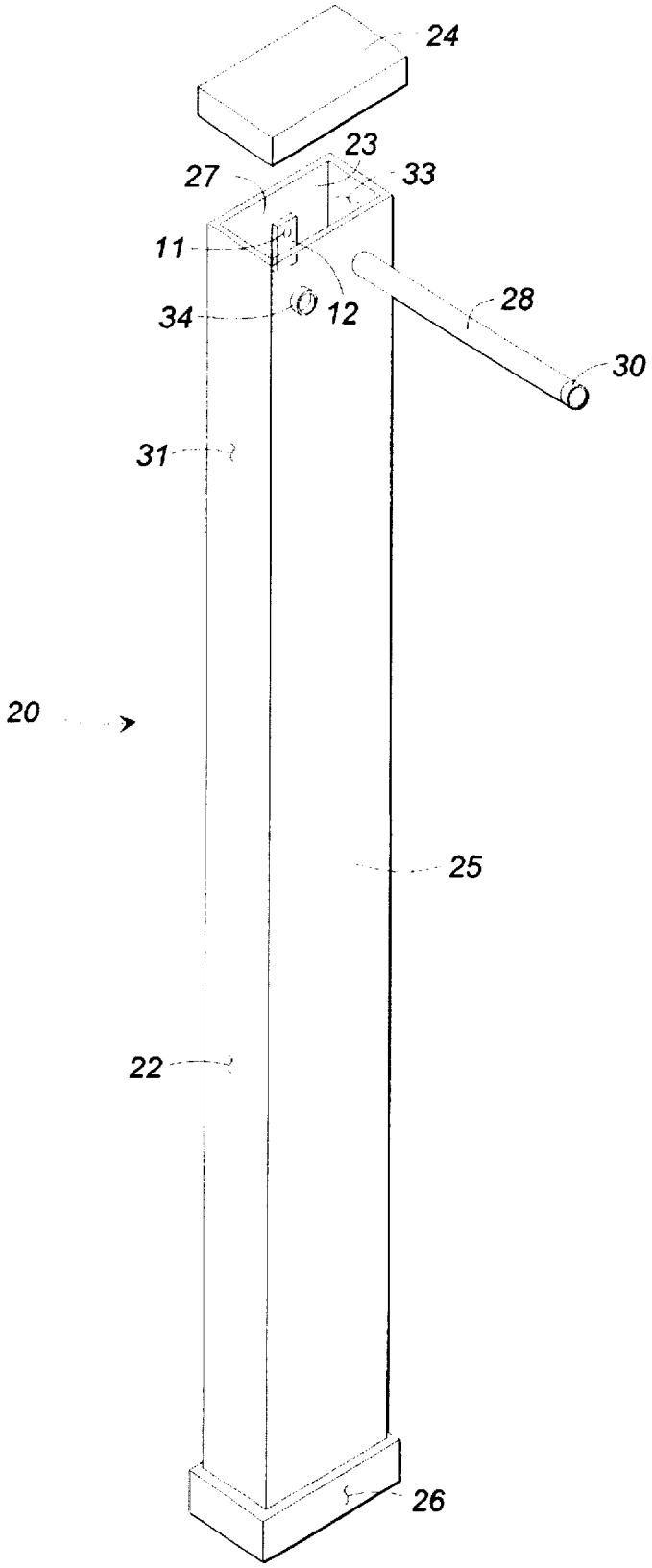
FIG. 2 is a perspective view of the cabinet of the hose take-up assembly illustrated in FIG. 1 illustrating the location of the stop.

Referring now to the drawings in which like reference characters indicate like parts throughout the several views, a first embodiment of the flexible hose take-up assembly 10 is illustrated in FIG. 1. As best seen in FIGS. 1 and 2, the flexible hose take-up assembly 10 includes an elongate cabinet 20 in which the flexible hose take-up assembly is housed. The cabinet 20 has a generally rectangular elongated hollow tubular tower 22 fitted at its opposed ends with a bottom end cap 26 and a removable top end cap 24. Cabinet 22 is constructed of aluminum, although, other non-corrosive metals and sufficiently rigid non-metallic materials can be used to construct the cabinet. The bottom end cap 26 is sized and shaped to mate with and seal the bottom portion of the tower 22, and acts as a support base for the cabinet 20. The top end cap 24 is sized and shaped to be received on the top end of the tower 22 and can be fitted with a seal if so desired. The top end cap 24 is easily removable in order to provide access to an interior chamber 23 defined within the cabinet 20. In this way, the chamber 23 can be initially filled with a damping liquid 38 and replenished so that a desired liquid level 40 can be maintained at an appropriate level as damping liquid will be lost over time due to evaporation and cable pay out.

Extending from the front panel 25 (FIG. 2) of the tower 22 is a first elongate sleeve 28 and a second sleeve 34. The first elongate sleeve 28 and second sleeve 34 are spaced from one another in a common horizontal plane and extend parallel to each other at right angles with respect to the plane of the front panel 25. As shown in FIGS. 1 and 2, the elongate sleeve 28 is fitted with a sleeve tip 30 at its distal end. Both the elongate sleeve 28 and the second sleeve 34 extend from openings 35 and 37, respectively, located near the top of the front panel 25. As shown in FIGS. 1 and 2, elongate sleeve 28 and second sleeve 34 provide a path of travel for the cable 42 of the pulley assembly. Typically, the sleeve tip 30 and the second sleeve 34 have rounded smooth surfaces to reduce the wear and tear on the cable 42 associated with cable pay out and retraction therethrough.

As shown in FIG. 1, the cabinet 20 houses the pulley assembly P, the counterweights 48 and 50, and a supply of damping liquid 38. The pulley assembly of the flexible hose take-up assembly 10 includes a pair of pulleys 44 and 46, an idler pulley 16, and a cable 42 passed over these pulleys. The first pulley 44 is attached to the top of a first counterweight 48, while the second pulley 46 is attached to the top of the second counterweight 50. The idler pulley 16 is rotatably mounted near the top of the rear panel 27 of the tower 22 on a suitable bearing 18. In the preferred embodiment a standard locking pin is used, however, any suitable bearing will suffice. The idler pulley 16 is centrally mounted to the rear panel 27 such that its direction of rotation is parallel to the plane of the rear panel 27. A stop 12 lies between idler pulley 16 and rear panel 27 and extends vertically beneath the idler pulley. The stop 12 is preferably a 1"×3"×⅜" piece or flat bar stock, and is used to limit the upward vertical movement of counterweights 48 and 50. As shown in FIG. 2, the stop 12 has an aperture 11 defined therein and sized to receive bearing 18 used to rotatably support idler pulley 16. As shown in FIG. 1, first pulley 44 and second pulley 46 are mounted on counterweights 48 and 50, respectively, such that the pulleys each rotate in a direction perpendicular to the planes of front panel 25 and rear panel 27 of the tower 22.

As illustrated in FIG. 1, the pulley assembly also includes a cable 42. The cable 42 extends from its first end 32 through the elongate sleeve 28 and into the interior chamber 23 of the cabinet 20 where it is passed around the pulleys 44, 16, and 46 in the manner in which a conventional block and tackle pulley assembly is constructed. The second opposite end 36 of cable 42 exits the interior chamber 23 of the cabinet 20 through the second sleeve 34. The ends 32 and 36 of the cable 42 are prevented from retracting into the interior chamber 23 by the first hose clamp 54 and second hose clamp 56 connected to the respective ends 32 and 36 of the cable 42.

When the flexible hose take-up assembly 10 is at rest, the first counterweight 48 and second counterweight 50 are positioned above the bottom end cap 26 in a home position within the tower 22. The counterweights 48 and 50 are generally rectangular in shape and are spaced apart by a fin 14 (FIG. 3) positioned in the chamber 23 and extending along the length of the front panel 25 of the tower 22. Fin 14 is formed as part of the tower, and may be welded, for example, or otherwise attached to the interior of front panel 25 within chamber 23. As illustrated best in FIGS. 3 and 4, first counterweight 48 and second counterweight 50 are sized so that, when centered within their respective halves of the interior chamber 23, the counterweights do not contact the tower 22 or the fin 14. However, first counterweight 48 and second counterweight 50 are each sized to be large enough to prevent their being rotated within the interior chamber 23.

As best shown in FIG. 1, the interior chamber 23 of the cabinet 20 is filled with a low viscosity damping liquid 38 to an optimal liquid level 40. The preferred low viscosity liquid, due in large part to its low cost and availability, is water. However, other low viscosity liquids, including, but not limited to, light-weight oils can be used. Optimal liquid level 40 lies in the range between a maximum liquid level and a minimum liquid level. The maximum liquid level is set by the elongate sleeve 28 and the second sleeve 34. Any damping liquid added beyond this maximum liquid level will simply drain from the elongate sleeve 28 and second sleeve 34. The minimum liquid level is defined by the length of the counterweights 48 and 50 when the counterweights 48 and 50 are at their maximum elevation within the interior chamber 23 (i.e., when the hose 52 is fully extended). In order to provide a uniformly controlled retraction rate for the entire length of hose 52, it is anticipated that damping liquid 38 will be in contact with both the first counterweight 48 and second counterweight 50 when the counterweights have traveled to their maximum elevation within interior chamber 23 during use, i.e., when the hose is withdrawn from its stored position (FIG. 1) into one of its fluid dispensing positions.

During the winter months, and/or whenever the flexible hose take-up assembly is exposed to atmospheric conditions that could result in the freezing of damping liquid 38, damping liquid 38 will need to contain a suitable water/anti-freeze mixture in order to prevent freeze-up. Ethylene glycol is the preferred anti-freeze agent; however, other chemicals having low freezing points, such as alcohol are acceptable.

OPERATION

In operation, the first hose clamp 54 and second hose clamp 56 are fixedly attached to a flexible hose 52. Typically, as illustrated in FIG. 1, the tank end 62 of the hose 52 is connected to a supply tank (not shown) containing water, air or some other substance to be delivered through the hose 52. The nozzle end 60 of the hose is typically connected to a nozzle and/or a valve (not shown) for controlling the delivery of the chosen substance. When not in a fluid dispensing position, the hose 52 remains in the stored position adjacent the cabinet 20 of the flexible hose take-up assembly 10. When stored, the hose 52 is in an extended looped configuration, as shown. This configuration is a result of both the length of hose 52 intermediate the hose clamps 54 and 56, and the difference in length between the elongate sleeve 28 and the sleeve 34. This staggered looped configuration, also known as an accordion configuration, significantly reduces the instances of hose entanglement resulting from hose pay out and retraction when the hose is moved between the stored position and fluid dispensing position.

Still referring to FIG. 1, when the nozzle end 60 of the hose 52 is grasped by a user and pulled to a fluid dispensing position (not shown), the first end 32 of cable 42 connected to the hose 52 via the hose clamp 54 is drawn through the elongate sleeve 28 in the direction of arrow A. In response to the tension being applied to cable 42, first counterweight 48 rises within the interior chamber 23 of cabinet 20 through the damping liquid 38 in the direction of arrow A'. When the hose is pulled a sufficient distance away from the cabinet 20, the pulley assembly mechanical advantage cross-over point is reached and the second counterweight 50 begins to rise along the cable 42 with the assistance of second pulley 46 in the direction of arrow B'. Once the first end 32 of cable 42 attached to clamp 54 has been withdrawn from the cabinet 22 far enough so that the slack in the length of hose intermediate the clamp 54 and clamp 56 is gone and the hose is taught, the second end 36 of the cable 42 connected to clamp 56 will be withdrawn through sleeve 34 in the direction of arrow B. Both ends of the cable 42 may continue to be withdrawn until the top portions of first counterweight 48 and second counterweight 50 contact the stop 12 mounted near the open end of cabinet 20. The stop 12 prevents further elevation of the counterweights 48 and 50 within the interior chamber 23. When the counterweights 48 and 50 are both stopped at their maximum elevation, the first end 32 of the cable 42 attached to clamp 54, and the second end 36 of cable 42 attached to clamp 56, are fully withdrawn from elongate sleeve 28 and sleeve 34, respectively, and hose 52 is fully extended such that the nozzle end of the hose 60 is at a maximum distance away from the cabinet 20.

When fluid dispensing using the hose 52 is complete, the user can merely release the hose 52 and it will automatically retract at a uniform rate. The rate at which the hose 52 is retracted is controlled by the pulley assembly and the viscosity and liquid level 40 of damping liquid 38 stored within interior chamber 23 of cabinet 20. When the liquid level 40 is within the optimal range, the first counterweight 48 and second counterweight 50 are in constant contact with the damping liquid 38 regardless of their elevation within chamber 23. Thus, the hydraulic damping provided by the damping liquid 38 is immediately applied to the first counterweight 48 and second counterweight 50 upon their descent toward the home position within chamber 23. Because the damping liquid 38 is more dense than air, the rate at which the counterweights descend within the chamber 23 is reduced compared to a free fall, and thus the retraction rate of the hose 52 is likewise reduced.

Figure 3:
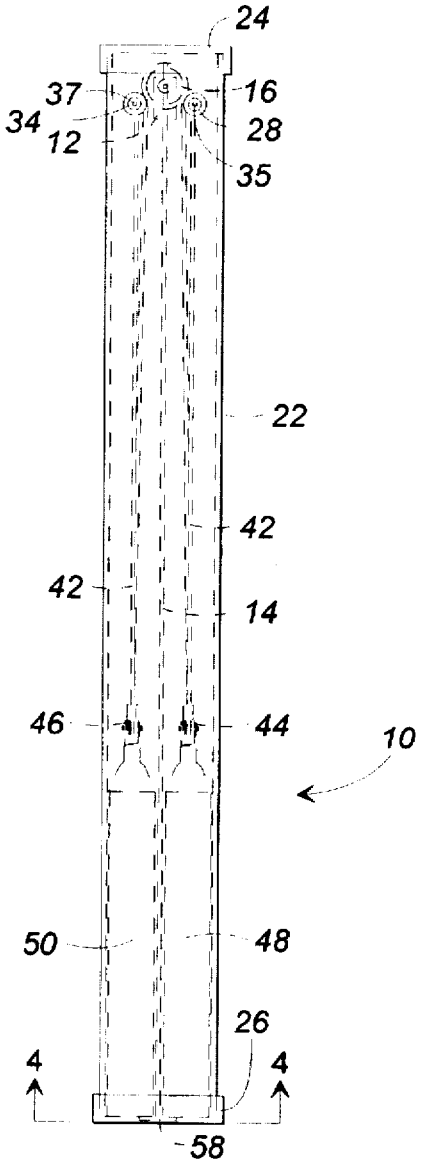
FIG. 3 is a front elevational view of the hose take-up assembly illustrated in FIG. 1.
Figure 4:
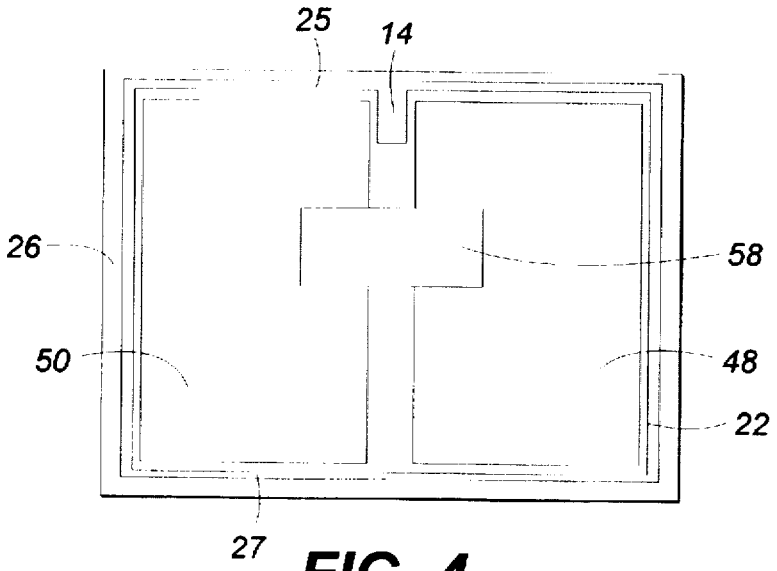
FIG. 4 is a bottom plan view of the hose take-up assembly illustrated in FIG. 1 illustrating the location of the support tab.

In order to prevent hose entanglement, it is desirable to maintain the hose 52 in the stored position as shown in FIG. 1 when the hose is not in use. For this reason, it is intended that flexible hose take-up assembly 10 include a support tab 58 as shown in FIGS. 3 and 4. The support tab 58 can be constructed from aluminum or any other rigid and durable material, and is attached to the bottom of the second counterweight 50 such that it extends beneath the first counterweight 48. The function of the support tab 58 is to prevent the first counterweight 48 from descending ahead of the second counterweight 50 when the hose 52 is released from one of its fluid dispensing positions. As a result, the hose 52 is returned to the stored position in an accordion configuration.

Figure 5:
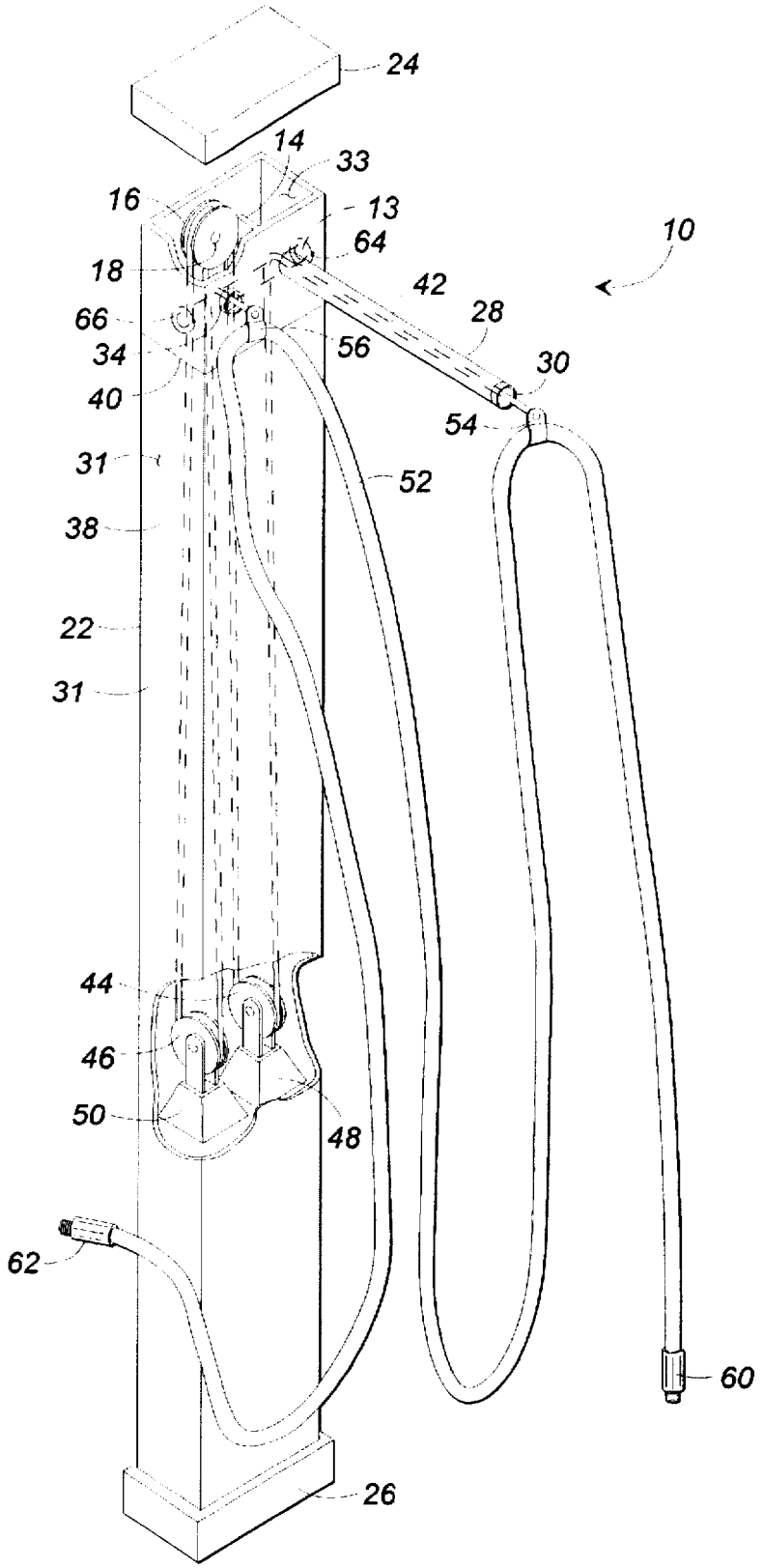
FIG. 5 is a partially cut-away perspective view of an alternate embodiment of the hose take-up assembly of this invention.

A second embodiment of the flexible hose take-up assembly 10 is illustrated in FIG. 5. The embodiment of the flexible hose take-up assembly 10 illustrated in FIG. 5 incorporates a roller bar 13 rather than a stop 12. The roller bar 13 of this embodiment takes the form of a nut and a smooth shank bolt extending just beneath the elongate sleeve 28 and sleeve 34 through holes 64 and 66 defined in the opposed side panels 31 and 33 of tower 22. Like the elongate sleeve 28 and sleeve 34, the roller bar 13 is constructed to provide a smooth surface for cable 42 to travel along during pay out and retraction. Roller bar 13 also acts as a stop to limit the maximum elevation of the first counterweight 48 and second counterweight 50. When the hose 52 is fully paid out, the first pulley 44 and second pulley 46 both come in contact with the roller bar 13, which stops the upward motion of the counterweights.

In each of the above-referenced embodiments, the preferred cable 42 is a nylon coated braided wire. Additionally, a small amount of a relatively light-weight, i.e., less dense, more buoyant, cooking oil is preferably added to the damping liquid 38 to act as a lubricant for cable 42. Because the oil floats on top of water, in those instances where damping liquid 38 is water, the cable 42 is coated with a thin film of oil as it is withdrawn from liquid 38. For optimum performance, counterweights 48, 50 will be balanced in relationship to the weight of the hose 52 being used. Heavier counterweights are needed for full retraction when the hose weight increases. Additionally, the height of tower 22 will be determined by the length of hose 52 being used. As hose length increases, so does tower height. This provides the necessary space within the tower 22 for the appropriate length of cable 42 needed to fully retract the hose.

By way of example, and not limitation, when take-up assembly 10 is constructed for a 25'×¼" standard hose commonly used in the industry, the internal dimensions of tower 52 are approximately 84 inches in height, 4 inches in width, and 2 inches in depth. For these dimensions the counterweights 48 and 50 are each 19"×1⅝" square bars weighing approximately 14.17 pounds. The cable 42 attached to the hose 52 is 21'7" long eye-to-eye, and the elongate sleeve 28 extending from the tower 22 is 6 inches long. When a longer hose 52 is used, the tower 22 and cable 42 will preferably be taller and longer, respectively, and the weights 48, 50 will be heavier in order to effect complete retraction of the hose 52. Likewise, when the hose 52 is shorter, the tower 22 and cable 42 can be shorter, and the weights 48 and 50 can be lighter.

While preferred embodiments of the invention have been disclosed in the foregoing specification, it is understood by those skilled in the art that variations and modifications thereof can be made without departing from the spirit and scope of the present invention, as set forth in the following claims. In addition, the corresponding structures, materials, acts, and equivalents of all means or step plus function elements in the claims below are intended to include any structure, material, or acts for performing the structure in combination with other claimed elements, as specifically claimed herein.

I claim:

1. A flexible hose take-up assembly for use in paying out and automatically retracting an elongate flexible fluid dispensing hose reciprocably supported on said take-up assembly between a first stored position and a range of second extended fluid dispensing positions, comprising:

an elongate tubular cabinet, said cabinet having a first closed end and a second open end;

a generally liquid tight chamber defined within said cabinet, said chamber being filled with a predetermined amount of a damping liquid;

a spaced pair of openings defined within said cabinet at the second end thereof, said openings being in communication with said chamber;

an elongate cable having a first end and a spaced second end, the first end of said cable being passed outwardly through one of said openings from said interior chamber, the second end of said cable also being passed outwardly from within said interior chamber through the other one of said openings;

the respective ends of said cable being clamped onto the flexible hose;

a pulley assembly positioned within said chamber, said pulley assembly comprising a first pulley, a second pulley, and an idler pulley positioned intermediate said first and said second pulleys;

a first counterweight fastened to said first pulley and a second counterweight fastened to said second pulley;

wherein said cable is passed over said first, said intermediate, and said second pulleys within said interior chamber;

said cable and said pulley assembly being constructed and arranged to move said counterweights upwardly within said chamber in response to the movement of the fluid dispensing hose from its stored position into one of its fluid dispensing positions; and wherein said counterweights are at least partially immersed within said damping fluid held within said chamber.

2. The flexible hose take-up assembly of claim 1 wherein said first and second counterweights are constructed and arranged to move downwardly through said fluid within said chamber to retract the fluid dispensing hose toward its stored position on said assembly in response to the release of the fluid dispensing hose in one of its fluid dispensing positions.

3. The flexible hose take-up assembly of claim 1 wherein said pulley assembly is constructed and arranged to permit said counterweights to move downwardly within said chamber in response to the force of gravity once the hose is released from one of its extended fluid dispensing positions.

4. The flexible hose take-up assembly of claim 3 further comprising an elongate fin positioned within said chamber and extending from the first closed end toward the second open end of said cabinet, said fin being constructed and arranged to define a separate path of travel for each respective one of said counterweights.

5. The flexible hose take-up assembly of claim 1 further comprising a first sleeve and a second elongate sleeve extending from said pair of openings and away from said cabinet, said first and second sleeves being constructed and arranged to support said cable such that said fluid dispensing hose is in an accordion arrangement when the fluid dispensing hose is in its stored position.

6. The flexible hose take-up assembly of claim 1 wherein said cabinet includes a rear panel, said idler pulley rotatably supported on said rear panel and being spaced therefrom, said take-up assembly further comprising a stop mounted on said rear panel and being positioned with respect to the idler pulley, said stop being constructed and arranged to contact said counterweights when said counterweights are moved upwardly within said chamber.

7. The flexible hose take-up assembly of claim 1 wherein said liquid is one of the liquids selected from the group consisting of water, a water and oil mixture, a water-ethylene glycol mixture, and a water-oil-ethylene glycol mixture.

8. The flexible hose take-up assembly of claim 3 further comprising a tab mounted on said second counterweight, said tab being constructed and arranged to limit the downward travel of said first counterweight within said chamber.

9. A flexible hose take-up assembly for use in paying out and automatically retracting an elongate flexible fluid dispensing hose reciprocably supported on said take-up assembly between a first stored position and a range of second paid out fluid dispensing positions, said take-up assembly comprising:

an elongate tubular cabinet, said cabinet being open at one end;

a generally water-tight chamber defined within said housing, said chamber being in communication with the open end of said cabinet and being filled with a predetermined amount of a damping liquid;

at least one counterweight stationed in a home position within said chamber, said at least one counterweight being at least partially immersed in said damping liquid in said home position; and means, supported on said cabinet and engaged with the fluid dispensing hose, for permitting the movement of said at least one counterweight in a first direction away from said home position within said chamber in response to the movement of the flexible hose from its stored position into one of its fluid dispensing positions, and for permitting the gravitational movement of said at least one counterweight in a second direction back to said home position in response to the release of the fluid dispensing hose from its fluid dispensing position;

wherein said damping liquid dampens the movement of said at least one counterweight in said second direction within said chamber as the fluid dispensing hose is retracted toward its stored position on said assembly;

whereby the rate of speed at which the fluid dispensing hose is retracted to its stored position is controlled by the damped movement of said at least one counterweight in said second direction as said at least one counterweight moves at least partially through the damping fluid held within said chamber.

10. The flexible hose take-up assembly of claim 9 wherein said means for permitting the movement of said at least one counterweight comprises a pulley assembly positioned within said chamber and an elongate cable, said cable having first and second ends attached to the fluid dispensing hose at a first position and a spaced second position, respectively, said cable being operably engaged with said pulley assembly intermediate the ends thereof.

11. The flexible hose take-up assembly of claim 10 wherein said cabinet includes a rear panel and wherein said pulley assembly comprises at least one pulley and an idler pulley, said at least one pulley being secured to said at least one counterweight, and said idler pulley being rotatably mounted on the rear panel of said cabinet adjacent the open end thereof.

12. The flexible hose take-up assembly of claim 9 further comprising a first opening and a spaced second opening defined within said cabinet adjacent the open end thereof, said first and second openings being in communication with said chamber.

13. The flexible hose take-up assembly of claim 12, further comprising a first counterweight and a second counterweight, and wherein said means for permitting movement comprises a first pulley attached to said first counterweight and a second pulley attached to said second counterweight, an idler pulley mounted to said cabinet intermediate the first and second pulleys, and an elongate cable having a first end and a spaced second end, the first end of said cable being passed outwardly from said chamber through said first opening, and the second end of said cable being passed outwardly from said chamber through said second opening, said cable being passed over said first, said idler and said second pulleys within said chamber.

14. The flexible hose take-up assembly of claim 13 further comprising an elongate fin positioned within said chamber and defining a separate path of travel for said first and said second counterweights, respectively, as said counterweights are moved in said first and second directions.

15. The flexible hose take-up assembly of claim 9 further comprising a stop mounted to said cabinet within said chamber adjacent the open end of said cabinet, said stop being constructed and arranged to limit the movement of said at least one counterweight in the first direction.

16. A method of controlling the rate of speed at which a flexible fluid dispensing hose supported on a flexible hose take-up assembly is automatically retracted into a stored position on said assembly from any one of a range of paid out fluid dispensing positions, said method comprising the steps of:

(a) at least partially immersing at least one counterweight within a generally water-tight chamber in a home position, said water-tight chamber being defined within a cabinet formed as a part of said take-up assembly, said chamber being filled with a predetermined amount of a damping liquid;

(b) moving said at least one counterweight in a first direction away from said home position within said chamber in response to the movement of the flexible hose from its stored position into one of its fluid dispensing positions;

(c) gravitationally moving said at least one counterweight in a second direction within said chamber in response to the release of the fluid dispensing hose from one of its fluid dispensing positions;

(d) damping the movement of said at least one counterweight within said chamber toward said home position with said damping liquid;

(e) retracting the fluid dispensing hose toward its stored position on said assembly in response to the movement of said at least one counterweight toward said home position; and (f) controlling the rate of speed at which the fluid dispensing hose is retracted into its stored position in response to damping the movement of said at least one counterweight within said chamber.

17. The method of claim 16 where in step (a) said method further comprises the step of filling said chamber with said damping liquid between a range of liquid levels.

18. The method of claim 16 wherein step (b) further comprises the steps of:

positioning said first and second counterweights within the water-tight cabinet in a home position;

fastening a first pulley to said first counterweight and fastening a second pulley to said second counterweight;

mounting an idler pulley to said chamber intermediate said first and second pulleys;

passing a cable over said first, said idler and said second pulleys; and connecting a first end and a second end of said cable to the fluid dispensing hose outwardly of said cabinet.

19. The method of claim 18 further comprising the step of providing an elongate fin on said cabinet within said chamber and defining a separate path of travel for said first counterweight and said second counterweight, respectively, as said first and second counterweights move within said damping liquid toward and away from the home position.

* * * * *